US010130835B1

(12) United States Patent
Leonard

(10) Patent No.: US 10,130,835 B1
(45) Date of Patent: Nov. 20, 2018

(54) THREE EXERCISE COMBINATION DEVICE TO ALLEVIATE SCIATICA AND LOW BACK PAIN

(71) Applicant: David Kenneth Leonard, Raymore, MO (US)

(72) Inventor: David Kenneth Leonard, Raymore, MO (US)

( * ) Notice: Subject to any disclaimer, the term of this patent is extended or adjusted under 35 U.S.C. 154(b) by 35 days.

(21) Appl. No.: 13/999,822

(22) Filed: Mar. 14, 2014

(51) Int. Cl.
*A63B 21/00* (2006.01)

(52) U.S. Cl.
CPC ..... *A63B 21/00047* (2013.01)

(58) Field of Classification Search
CPC ..... A61G 15/02; A61G 15/007; A61G 15/08; A47C 1/0242; A47C 1/03211; A47C 1/032; A47C 1/024; A63B 24/0087; A63B 23/03516; A63B 23/03525; A63B 23/0355; A63B 23/03575; A63B 23/00178; A63B 23/04; A63B 23/0405; A63B 2208/0233; A63B 2208/0238; A63B 2208/0242; A63B 2208/0247; A63B 2208/0252; A63B 21/1492; A63B 21/1496; A63B 21/0058; A63B 2023/006
USPC ..... 297/69
See application file for complete search history.

(56) References Cited

U.S. PATENT DOCUMENTS 4,688,557 A * 8/1987 Bradstreet ..... A61H 1/0218 297/330
5,098,158 A * 3/1992 Palarski ..... A47C 1/022 297/234
5,217,488 A * 6/1993 Wu ..... A61H 1/0218 602/32
5,437,609 A * 8/1995 Leonard ..... A61H 1/0229 297/313
5,722,937 A * 3/1998 Smith ..... 601/23
6,213,923 B1 * 4/2001 Cameron ..... A63B 21/012 297/50
2002/0140268 A1 * 10/2002 Lew ..... 297/362.11

* cited by examiner

*Primary Examiner* — Sarah B McPartlin

(57) ABSTRACT

A Three combination exercise table-chair device intended to reduce the pain and symptoms associated with low back pain & sciatica. This device is designed to be used by qualified operators in physical therapy offices, chiropractic offices, and rehabilitation clinics. By means of electric motors and gearboxes, the operator can adjust a moveable foot pad which raises the lower torso through varying degrees of incline to provide stretching, flexibility and range of motion. These functions are achieved by using three specific exercises of the Williams Exercise Protocol. The Williams Exercise Protocol is a specific set of exercises that are further described in the description of the device.

2 Claims, 7 Drawing Sheets

THREE EXERCISE COMBINATION DEVICE TO ALLEVIATE SCIATICA AND LOW BACK PAIN

CROSS REFERENCE TO RELATED APPLICATIONS

Please refer to the Provisional Patent application No. 61/793,815

STATEMENT OF FEDERALLY SPONSORED RESEARCH/DEVELOPMENT

N/A

PARTIES TO A JOINT RESEARCH AGREEMENT IF THE CLAIMED INVENTION WAS MADE AS A RESULT OF ACTIVITIES WITHIN THE SCOPE OF A JOINT RESEARCH AGREEMENT

N/A

REFERENCE TO A SEQUENCE LISTING, TABLE, OR A COMPUTER PROGRAM LISTING APPENDIX

N/A

DESCRIPTION

The instant invention relates to a motorized table and chair device which is used to support the body from a seated position to a reclined position during which specific exercises called the "Williams Exercise Protocol" are used to stretch and increase the flexibility and range of motion to targeted muscles and structures of the human body.

Williams Exercises—are a set or system of related physical exercises intended to enhance lumbar flexion, avoid lumbar extension, and strengthen the abdominal and gluteal musculature in an effort to manage low back pain non-surgically. The system was first devised in 1937 by Dr. Paul C. Williams (1900-1978), then a Dallas orthopedic surgeon. At the 4th and 5th lumbar levels, great pressure is said to be exerted on the posterior aspect of each vertebra and transferred from the vertebra to the disc. Williams specified that in most cases the 5th lumbar disc ruptures and the nuclear material of the disc moves into the spinal canal causing pressure on the spinal nerves. In addition to the ruptured disc, irritation of the nerve at the intervertebral foramen where the nerve exits from the spinal canal may result. "The fifth lumbar disc has ruptured in the majority of all persons by the age of twenty . . . ." He went on to explain that although most people at this age have not experienced severe low back pain, they will, in all likelihood be subject to mild bouts of low back pain which can be attributed to the ruptured disc. The solution, Williams explained, was to have the patient perform exercises and adhere to postural principles which serve to decrease the lumbar lordosis to a minimum, thereby reducing the pressure on the posterior elements of the lumbar spine.

The Williams Exercises (WE) were for many years the standard for non-surgical low back pain treatment.

These exercises were performed in the supine position on a floor or other flat surface. There were variations, but the primary maneuver is to grab the legs and pull the knees up to the chest and hold them there for several seconds. The patient then relaxes, drops the legs down and repeats the exercise again. The primary benefit is researched to be the opening of the intervertebral foramen, the stretching of ligmentous structures, and the distraction of the apophyseal joints. (Facet joints). The goals of performing these exercises were to reduce pain and provide lower trunk stability by actively developing the "abdominal, gluteus maximus, and hamstring muscles as well as . . . " passively stretching the hip flexors and lower back (sacrospinalis) muscles. Williams said: "The exercises outlined will accomplish a proper balance between the flexor and the extensor groups of postural muscles . . . ". Williams suggested that a posterior pelvic-tilt position was necessary to obtain best results. This flexion has been shown to help mitigate back pain and has been demonstrated to accomplish the following: a) significantly increase the canal area, b) increase the midsagittal diameter, c) increase the subarticular sagittal diameter, and d) increase all the foraminal dimensions significantly. Although there are several variations of the exercises, three of the variations of the WEs are outlined below that are specifically targeted with the new and instant device. Specific Williams Exercises:

1. Single Knee to chest. Lie on your back with knees bent and feet flat on the floor. Slowly pull your right knee toward your shoulder and hold 5 to 10 seconds. Lower the knee and repeat with the other knee. Double knee to chest. Begin as in the previous exercise. After pulling right knee to chest, pull left knee to chest and hold both knees for 5 to 10 seconds. Slowly lower one leg at a time.
2. Hamstring stretch. Lie on your back with knees bent and feet flat on the floor. Start by crossing your right leg over the left one at the junction of the knee. Using a towel or hands grab underneath the left leg. Slowly pull your left knee toward your shoulder and hold 5 to 10 seconds. Lower the leg and repeat with the maneuver with the other leg. Cross the left leg over the right leg and repeat the stretching.
3. Back Extension Stretch: Laying on the floor place a curved pillow underneath the small of the lower back. Bring the knees to the chest as in the double knee to chest move. This motion extends the lower back spin.

This device specifically is designed to target the lumbosacral muscles, the hamstring muscles, the gluteal muscles, the intervertebral discs, the lumbar facets joints, the lumbar sacral vertebra and the pelvic structure while using the (3) three specific Williams Exercise protocols as mentioned in exercises 1, 2, and 3.

BACKGROUND OF THE INVENTION

Approximately 80% of the American population suffers from low back pain, sciatica, and related pain and symptoms at some time in their life. The loss of economic activity, enjoyment of life, and monetary value associated with debilitating lower back pain and sciatica is estimated at Ten billion dollars annually. Physical Therapists and Rehab specialist often use very effective stretching exercises such as "Williams Exercise Protocol" to stretch a persons legs and lower body to help relieve the pain. Three specific exercises that are part of the "Williams Exercise Protocol" are 1) Single/Double knee to chest exercise, 2) Hamstring Stretch Exercise and 3) Back Extension stretch Exercise. This is all done with a continuous passive motion of the lower legs and torso. What is needed is a simple motorized table/chair combination device that would enable the user to duplicate these three specific exercises. This would allow the user to have the device facilitate their stretching and exercises, especially when they are in severe pain and unable to perform these specific exercises without help. The instant invention also allows the user to perform both passive and active exercises by means of applied resistance through the active participation of the user. There are many types of exercise devices out on the market but none are as designed with the specific intent of combining active and passive motion through three specific Williams Exercises in one easy to use table/chair device.

BACKGROUND PRIOR ART

Various attempts have been made to provide an exercise device that employs some of these exercises, but none of the prior art anticipate or perform the same functions as the instant invention.

The reclining chair of Studdard (U.S. 2003/0087737) shows a chair that is put in various positions for exercising, it has braces pulleys, and adjustable features but it is not motorized and does not perform the same functions as the current invention.

A patent by Stevens (U.S. D 340,269) shows a chair device with foot portions that move up and down but there is no reclining feature to adjust the degree of resistance or aggressiveness of the exercise feature. (U.S. Pat. No. 638, 260) by Crews shows a chair device where static exercises can be performed; however, the chair is not motorized and does not have the same features of the current invention.

Patents by Sterling (U.S. Pat. No. 4,921,247), Curtis (U.S. Pat. No. 5,470,298), Silco (U.S. Pat. No. 3,968,963) and Miller (U.S. Pat. No. 3,738,649) all show a chair-like device with arm exercisers and assemblies for the feet but none of them can perform the same functions as the instant invention. The invention by Marshall (U.S. Pat. No. 7,357,768) shows a motorized recliner chair device but it is designed to simulate walking and does not combine three exercises into one device. Reitz et al (U.S. Pat. No. 7,094,188) shows a chair device that is used for low-resistance exercises; however, it is not motorized and the exercises are generic and not specific such as the instant invention.

The invention by Palarski (U.S. Pat. No. 5,098,158) shows an articulated chair device but this is intended for relaxation and does not perform the specific exercise as the instant invention. Leib (U.S. Pat. No. 7,195,583) shows a posture and exercise seating device; however, this device does not perform the specific exercise of the instant invention. Lew Pat Pub (2002/0140268) describes a seating device that is used for positioning the body for medical procedures. It is not an exercise device, nor does he subscribe it to be an exercise device in any way. Also a quick examination of the patent shows that the legal status has lapsed.

Another invention by Smith U.S. Pat. No. 5,722,937 never mentions the specific exercises that I have explained in my patent application. Smith does mention continuous passive motion but he does not anticipate a device that is developed exclusively for recreating Williams Exercises.

Smith States:

"Various types of exercise, rehabilitation and testing protocols include concentric action, eccentric action, continuous passive motion and isometric contractions."

Again there is no mention of incorporating any type of Williams Exercise into his device.

None of these previously cited devices allow the user to employ both passive and active exercises by means of applied resistance by the user, which is another feature of the instant invention. None of these prior inventions allow the user to apply the unique three combination exercises delivered simultaneously by the instant invention. None of these previously cited devices allow the user to employ both passive and active exercises by means of applied resistance by the user, which is another feature of the instant invention. None of these prior inventions provide the unique three combination exercises delivered simultaneously by the instant invention.

SUMMARY OF THE INVENTION

The present invention provides a solution to the immense problem of low back pain and sciatica. The "Williams Exercise Protocols" consist of three separate exercises that are proven therapies for these conditions and are used by physical therapists, chiropractors and rehab specialists all over the world. The instant invention is in the form of a chair-table device which allows the user to begin the process of exercising in a seated position. The device is motorized and has a back rest, underarm supports, seat portion and a lower leg assembly with a foot rest assembly. The back rest assembly allows the user to recline to a completely supine position, the seat portion allows the user to sit comfortably, the lower leg assembly and foot rest assembly allows the user to have his legs raised and lowered in a continuous motion that will duplicate the "Williams Exercise Protocols". The degree of flexion and extension can be controlled by raising and lowering the foot rest assembly. A person would start out in a seated position much like a recliner chair. As the person is lowered to a supine position, the lower leg and foot rest assembly can begin to move and start the process of continuous motion. The instant invention also allows the user to perform both passive and active exercises by means of applied resistance through the active participation of the user. This feature allows the user to go beyond the passive exercise stage and begin to incorporate active exercises. This is another unique feature of the instant invention.

OBJECTS OF THE INVENTION

It is therefore an object of the invention to provide an exercise table-chair device to simulate the Williams Exercise Protocol for the user A further object of the invention is to provide a comfortable and easy means of stretching and exercising the specific muscles of the Hamstrings, Gluteus muscles, Lumbo-Sacral muscles and the lower back muscles.

A still further object of the invention is to provide the 3 combination exercises of 1) Single/Double knee to chest, 2) Hamstring Stretch and 3) Back extension stretch. This would be done with a continuous passive leg motion in a easy to use device.

Yet another object of the invention is to provide a safe and effective means of treating persons affected by sciatica and low back pain by use of the table-chair device, being supervised by a qualified operator such as a Physical therapist, Chiropractor or Rehab specialist.

These and other particular objects of the instant invention will become apparent when referencing is made to the accompanying drawings in which.

DETAILED DESCRIPTION OF THE INVENTION

Figure 1:
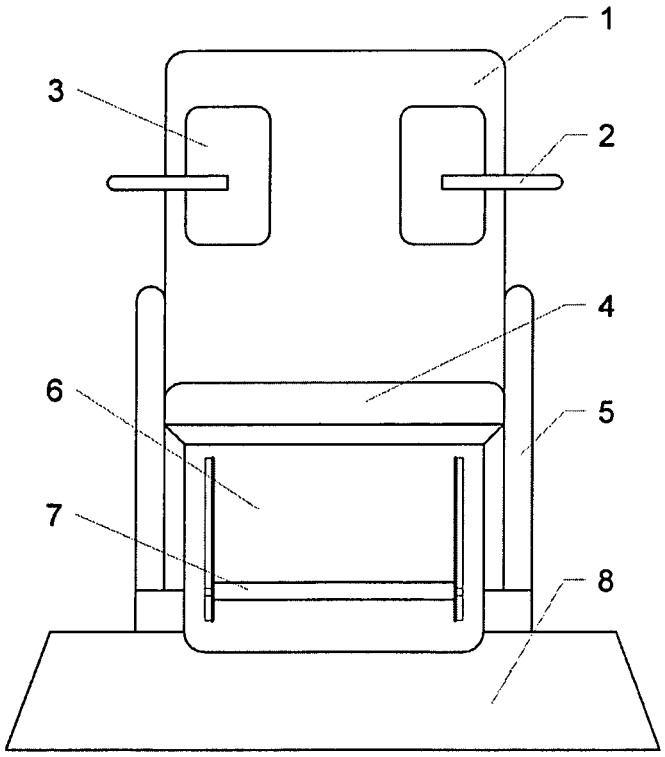
FIG. 1 is a front view of the device.
Figure 2:
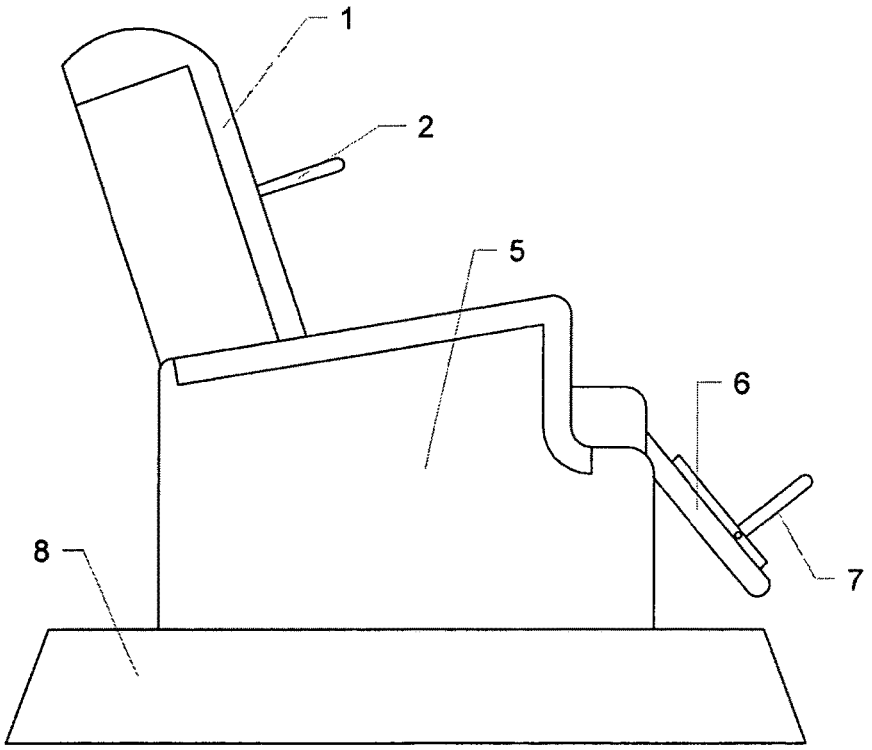
FIG. 2 is a side view of the device.
Figure 3:
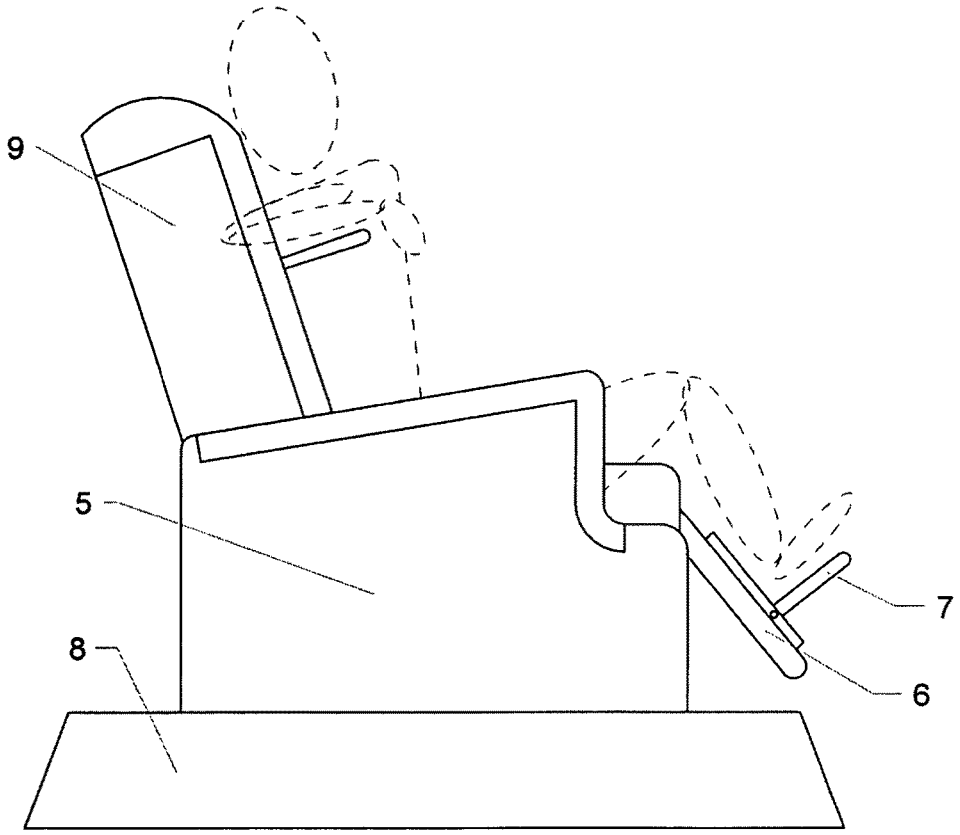
FIG. 3 is side view of the device with a user thereon in starting position.

Referring now to FIGS. 1 and 2; there is showing the chair-table device having a back rest section (1), a cushioned seat portion (4), an arm rest (2), an armrest opening (3) a side panel (5), a lower leg assembly section (6), a foot rest assembly section (7), a base table frame (8) and a back rest side panel (9). The table-chair device resembles an elevated recliner type of furniture. The user is assisted to the seated section (4) the user's back is resting against the backrest (I). Referring now to FIGS. 2 and 3; from a seated position the user's legs are placed on the leg rest assembly (6). The user's feet are then placed on the foot rest assembly (7). The user's arms are placed overtop the underarm assembly (2) for comfort and also to assist in gravity induced stretching of the lower torso. This is the starting position for the user.

Figure 4:
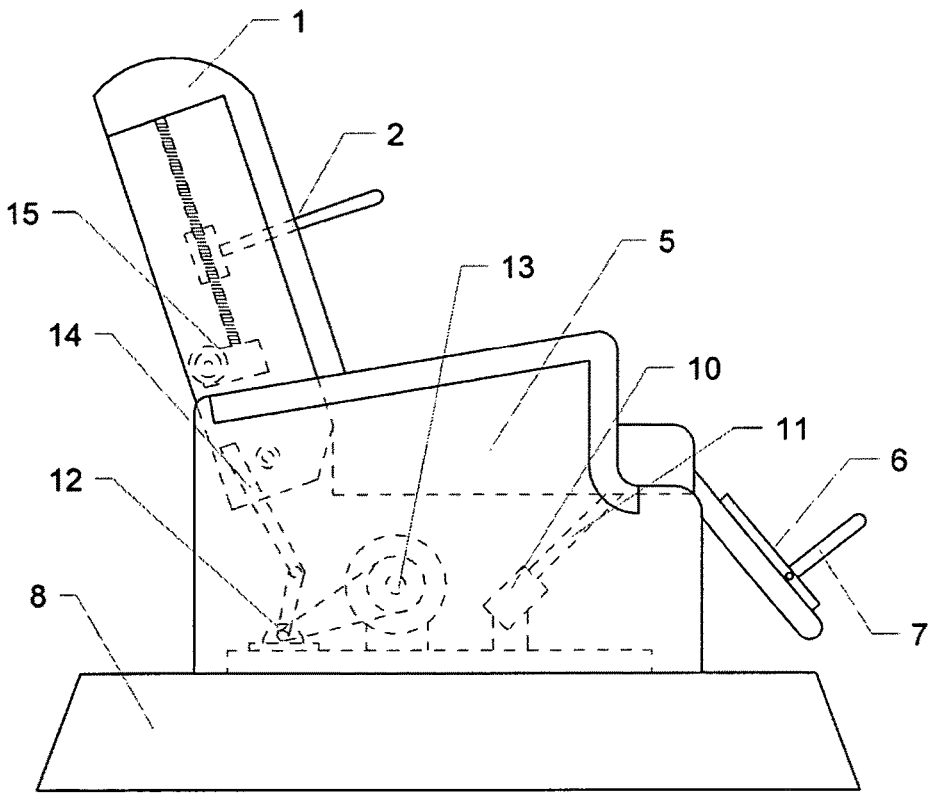
FIG. 4 is a side view of the device showing the mechanisms underneath in a normal starting position.

FIG. 4 shows the inner workings and mechanisms of the table-chair device having a lower torso elevation motor (10), lower torso elevation camshaft assembly (11), a back rest lowering worm screw assembly (12), a backrest lowering and elevation electric motor (13), a backrest lowering fulcrum assembly (14), and an arm rest assembly motor (15).

Figure 5:
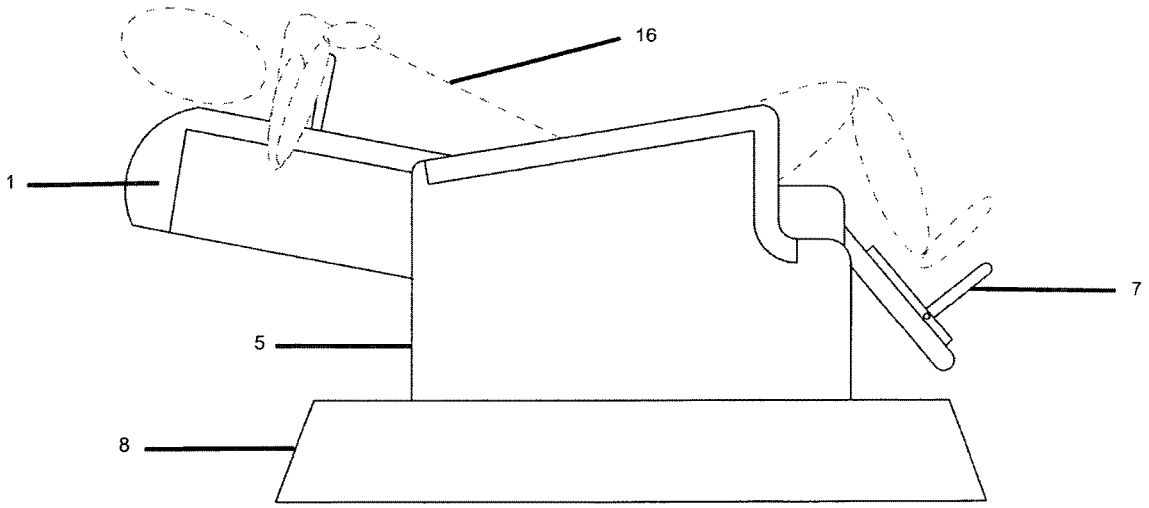
FIG. 5 is a side view of the device with a user thereon in the fully supine position with legs in starting position.

Referring now to FIG. 5, an operator then begins to lower the user into a fully supine position (16), the user places his feet on the foot rest assembly (7), the user's back is resting against the backrest assembly (1), the weight of the user is supported by the bilateral side panels (5) and by the base frame assembly (8).

Figure 6:
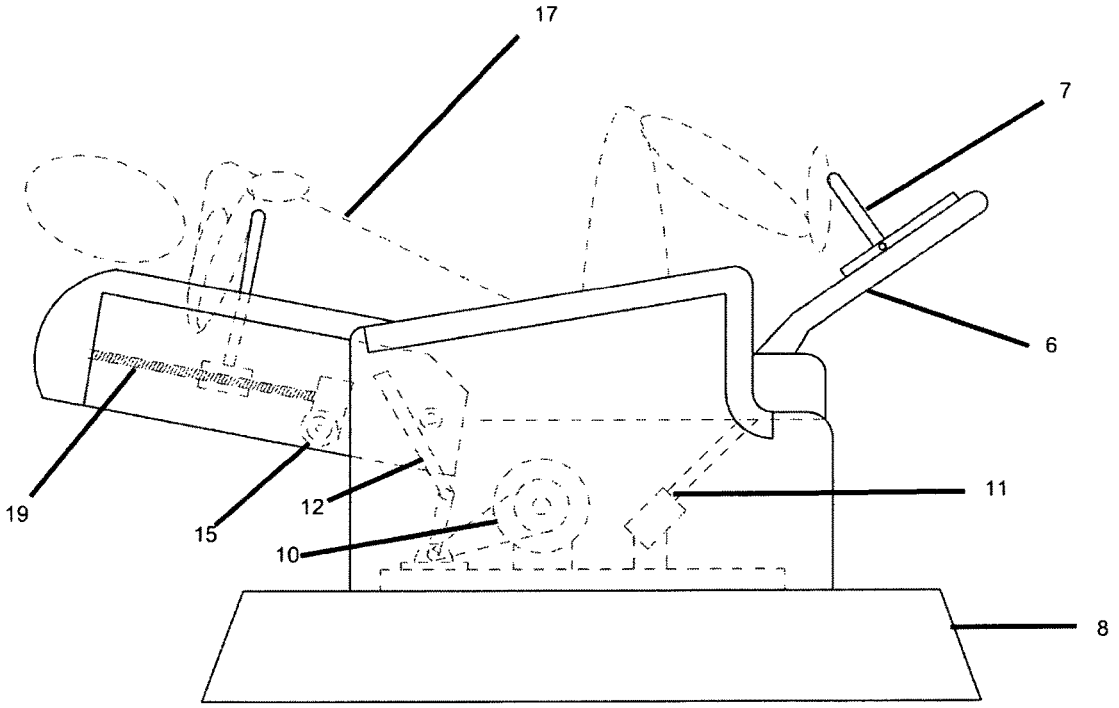
FIG. 6 is a side view of the device with the user thereon in the fully supine position with legs at maximum flexed position.

FIGS. 5 and 6 show the user thereon in the full flexion position (17) of the "Williams Exercise Protocol". Once in the fully supine flexed position (17), the user's legs that are resting against the foot rest assembly (7) begin to elevate towards the user's chest region. This action completes the full flexed position of the "Williams Exercise Protocol".

The operator of the table-chair device is controlling all aspects of this motion. FIG. 6 also indicates the inner mechanisms of the present invention that are making this mechanical action possible. (19) shows the arm rest worm screw assembly used to elevate the user's arm to assist in gravity induced stretching of the lower torso.

Figure 7:
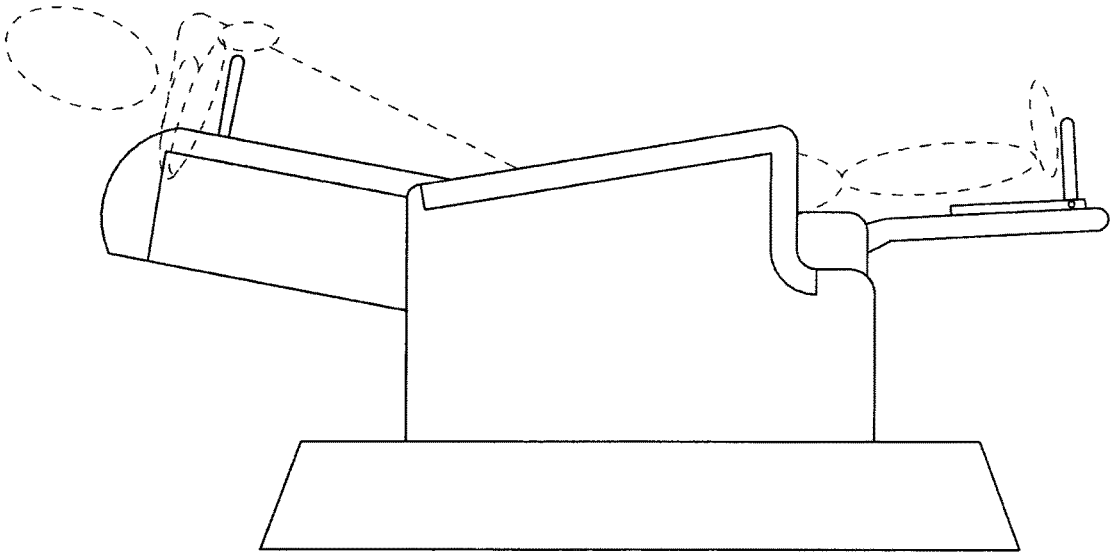
FIG. 7 is a side view of the device with the user thereon and in the Williams Back Extension position.

The trained operator assesses the position of the legs that are moving against the users chest. This is necessary to determine the optimum comfort and stretching level. The trained operator by means of a control box assembly begins to establish the correct cycling of the lower leg assembly (6) for optimum results. The elevating and raising of the lower leg assembly (6) is accomplished by actuation of the lower torso elevation cam assembly (11). The lower torso cam assembly (11) is powered by a lower torso elevation electric gear motor (10). When the user's legs are raised to the chest while in the seated position, this constitutes the Williams Single/Double knee to chest exercise portion of the Williams protocol (FIG. 6). Once in this seated position the user can also cross his legs to increase the amount of stretching in the Hamstring and Gluteus region. Also in this seated position while the user's legs are being raised, the user can begin an active exercise motion by resisting the force of the lower torso elevation electric motor (10). This serves to increase the strength and flexibility of the leg muscles. Through the use of the under arm support assembly (2) the user can rest his arms and begin to let gravity assist him in stretching his lower back and torso by means of the underarm support assembly (2) supporting the body's weight and allowing gravity to stretch the lower back and torso. FIG. 7 shows the user thereon in the Williams Back Extension position exercise. The trained operator controls all aspects of the table-chair operation. The trained operator also determines the length of treatment, degree of stretching, and the sequence of each particular exercise.

What is claimed is:

1. A powered chair table device comprising:

a base assembly;

two side panels extending upwardly from the base assembly;

a cushioned seat portion extending between the two side panels;

a backrest section pivotally with respect to the two side panels, wherein the backrest section is movable about a fulcrum by a backrest motor and screw assembly;

the backrest section further includes a first opening positioned on a first side of the backrest section and a second opening spaced apart from the first opening and positioned on a second side of the backrest section;

a pair of under arm assemblies, each of the underarm assemblies extending into a respective one of the first opening and the second opening and mounted for vertical adjustment along an armrest screw assembly positioned inside of the backrest section;

an arm rest assembly motor configured to actuate the armrest screw assembly and adjust a vertical position of each of the pair of under arm assemblies along the armrest screw assembly;

a lower leg assembly pivotally movable with respect to the cushioned seat portion by a lower torso elevation motor and lower torso elevation camshaft assembly from a first angle in which the lower leg assembly extends downward from an upper surface of the cushioned seat portion, through a position in which the lower leg assembly is essentially coplanar with the upper surface of the cushioned seat portion to a second angle in which the lower leg portion extends upward from the upper surface of the cushioned seat portion;

a foot rest assembly extending substantially perpendicular from the lower leg assembly; and a control box, wherein an operator uses the control box to independently and/or simultaneously actuate the backrest motor, the armrest motor and the lower torso elevation motor to provide extension, flexion, continuous passive motion and continuous active motion to a seat occupant.

2. The powered chair table device of claim 1, wherein the device is configured to support and adjust with a seated occupant while the seated occupant performs exercises, wherein the seated occupant can move their knees toward their chest during flexion into a flexion position;

the seated occupant can extend into a substantially supine position during extension; and the seated occupant can actively and continuously cycle their knees from a lowered position to a raised position through applied resistance or can passively and continuously cycle their knees from the lowered position to the raised position by actuation of the backrest motor, armrest motor and lower torso elevation motor.

* * * * *